US007351295B2

(12) United States Patent
Pawlik et al.

(10) Patent No.: US 7,351,295 B2
(45) Date of Patent: Apr. 1, 2008

(54) CLEANING AND POLISHING RUSTED IRON-CONTAINING SURFACES

(75) Inventors: Michael J. Pawlik, Glenshaw, PA (US); Robin M. Peffer, Valencia, PA (US)

(73) Assignee: PP6 Industries Ohio, Inc., Cleveland, OH (US)

( * ) Notice: Subject to any disclaimer, the term of this patent is extended or adjusted under 35 U.S.C. 154(b) by 63 days.

(21) Appl. No.: 11/387,208

(22) Filed: Mar. 23, 2006

(65) Prior Publication Data

US 2007/0221245 A1 Sep. 27, 2007

(51) Int. Cl.
*B08B 3/04* (2006.01)

(52) U.S. Cl. ..... 134/26; 134/4; 134/28; 134/34; 134/36; 134/40; 134/41; 134/902

(58) Field of Classification Search ..... 134/4, 134/26, 28, 36, 34, 40, 41, 42, 902
See application file for complete search history.

(56) References Cited

U.S. PATENT DOCUMENTS

| | | | | |
|---|---|---|---|---|
| 4,017,334 | A | 4/1977 | Matsushima et al. | 148/6.15 R |
| 5,108,544 | A | 4/1992 | Hakansson | 156/664 |
| 5,294,265 | A | 3/1994 | Gray et al. | 148/250 |
| 5,603,818 | A * | 2/1997 | Brent et al. | 204/488 |
| 5,662,746 | A * | 9/1997 | Affinito | 148/247 |
| 5,909,742 | A | 6/1999 | Ouyang et al. | 134/3 |
| 5,938,861 | A * | 8/1999 | Inoue et al. | 148/247 |
| 6,153,080 | A | 11/2000 | Heimann et al. | 205/199 |
| 6,210,491 | B1 | 4/2001 | Colgan et al. | 134/10 |
| 6,423,425 | B1 * | 7/2002 | Faucher et al. | 428/626 |
| 6,982,241 | B2 | 1/2006 | Smith et al. | 510/254 |
| 6,984,269 | B2 | 1/2006 | Motson | 134/38 |
| 2003/0132115 | A1 | 7/2003 | Andreae et al. | 204/480 |
| 2003/0221751 | A1 | 12/2003 | Claffey et al. | 148/247 |
| 2004/0151619 | A1 * | 8/2004 | Quellhorst et al. | 422/14 |
| 2004/0217328 | A1 * | 11/2004 | Matsui et al. | 252/388 |
| 2004/0217334 | A1 | 11/2004 | Heimann et al. | 252/500 |
| 2006/0180247 | A1 * | 8/2006 | Matzdorf et al. | 148/247 |
| 2006/0237098 | A1 * | 10/2006 | Matzdorf et al. | 148/247 |
| 2006/0240191 | A1 * | 10/2006 | Matzdorf et al. | 427/299 |
| 2007/0095435 | A1 * | 5/2007 | Lammerschop et al. | 148/244 |

* cited by examiner

*Primary Examiner*—Sharidan Carrillo
(74) *Attorney, Agent, or Firm*—Donald R. Palladino

(57) ABSTRACT

A method for cleaning and polishing a rusted iron-containing metal surface is disclosed. The metal surface is contacted with a composition containing fluorometallate anions of a Group IVB metal.

21 Claims, No Drawings

CLEANING AND POLISHING RUSTED IRON-CONTAINING SURFACES

FIELD OF THE INVENTION

The invention relates to a process for treating rusted iron-containing metal surfaces. The process removes the rust and leaves a polished, silver-like surface.

BACKGROUND INFORMATION

During metal processing or simply upon exposure to the atmosphere, a metal oxide layer is often formed over all or part of the metal surface impairing its appearance and/or suitability for further use. One example is steel including particularly mild steel used for fasteners such as screws and bolts. Although the fastener is initially manufactured with a bright, shiny finish, the fastener, upon exposure to the atmosphere, becomes covered wholly or partially with an oxide layer that imparts a dull or blackened appearance. Accordingly, it is desired to remove the metal oxide layer. The conventional way of removing the metal oxide layer is to treat the rusted metal surface with a strong acid such as nitric or sulfuric acid. However, these acids can create environmental problems such as $No_x$ emissions from the use of nitric acid. Also, in the case of fasteners made of mild steel, such strong acid treatments leave the surface with a dull rather than a polished silver-like appearance which is desirable.

SUMMARY OF THE INVENTION

In accordance with the present invention, a method of cleaning and polishing a rusted iron-containing metal surface is provided. The method comprises treating the surface with a composition comprising fluorometallate ions of a Group IVB metal such as fluorozirconic acid or soluble salts thereof.

DETAILED DESCRIPTION

The metal substrate treated in accordance with the present invention is a mixture of iron and carbon and which can contain iron and carbon, such as steel, and which may be alloyed with other metals such as manganese, chromium and nickel. The invention is particularly effective on mild steel such as is typically used in fasteners such as screws and bolts. Mild steel is also referred to as low carbon steel and contains less than 0.25% by weight carbon. Such steel is strong and easily shaped into fastener configuration.

However, mild steel surfaces are easily oxidized upon exposure to the atmosphere resulting in a rusted unsightly appearance.

The composition that is used to treat the rusted surface comprises fluorometallate ions of a Group IVB (of the Periodic Chart of elements) metal. The preferred Group IVB metal is zirconium. An example of fluorometallate anions is fluorozirconate anion such as hexafluorozirconate. Preferably, the composition also contains hydrogen cations such as those associated with hexafluorozirconic acid. The preferred composition comprises hexafluorozirconic acids and its water-soluble salts such as the sodium or potassium salts.

The fluorometallate anions of the Group IVB metal are typically in aqueous solution in which the Group IVB metallate is typically present in amounts of 20 to 80 percent by weight based on total weight of the solution with water constituting 20 to 80 percent by weight based on total weight of the solution. Other ingredients such as wetting agents, cosolvents and corrosion inhibitors can optionally be present in amounts of up to 40 percent by weight based on total weight of the solution. The treating composition is typically contacted with the rusted iron-containing metal surface by conventional means such as immersion or spraying with immersion being preferred. The temperature of the treatment is not particularly critical and temperatures from 15 to 90° C. can be used.

Preferably, the treating composition is in contact with the rusted iron-containing metal surface for at least 30 minutes. A preferred treatment involves immersing the rusted metal surface in a treating composition for 6 to 48 hours. After the rusted iron-containing metal surface is contacted with the Group IVB fluorometallate, it may then be subsequently rinsed with water and then further rinsed with an organic solvent, preferably water-miscible organic solvent, lower alkyl alcohols such as isopropanol; ketones such as acetone and methyl ethyl ketone. Also, hydrocarbons such as hexane and toluene can be used. The water rinse removes a dull gray film that forms on the treated metal surface. Rinsing with water results in a bright shiny silver-like appearance. The subsequent rinse with the organic solvent prevents rapid re-rusting of the treated metal surface.

To preserve the cleaned and polished appearance, the metal surface can be coated with a clear coating composition. Preferably the coating is applied by electrodeposition and the coating composition is a cationic electrodepositable composition. In the case of metal fasteners, the electrodepositable composition can be applied as disclosed in U.S. Published Patent Application No. 2003/0132115.

Other than in the operating examples where otherwise indicated, all numbers expressing quantities of ingredients, reaction conditions, etc. used in the specification and claims, are to be understood as being modified in all instances by the term "about". Accordingly, unless indicated to the contrary, the numerical parameters set forth in the specification and claims are approximations that may vary depending upon the desired properties sought to be obtained by the present invention. At the very least and not as an attempt to limit the application of the Doctrine of Equivalents to the scope of the claims, each numerical parameter should be at least construed in light of the number of reported significant digits by applying ordinary rounding techniques.

Notwithstanding the numerical ranges and parameters setting forth the broad scope of the invention are approximations, the numerical values set forth in the specific example are reported as precisely as possible. Any numerical values, however, inherently contain certain errors necessarily resulting from standard deviation found in their respective testing measurements.

Also, it should be understood that any numerical range recited herein is intended to include all subranges subsumed therein. For example, a range of "1 to 10" is intended to include all subranges between (and including) the recited minimum value of 1 and the recited maximum value of 10, that is, having a minimum value equal to or greater than 1 and a maximum value of equal to or less than 10.

The following Example demonstrates the preparation of a treatment composition and the use of the composition to treat a rusted iron-containing metal substrate. Unless otherwise indicated in the Examples and elsewhere in the specification and claims, all parts and percentages are by weight. Temperatures are in degrees Centigrade and pressures are at or near atmospheric pressure.

EXAMPLE

Chemical Polishing of Fastener

At ambient temperature, a rusty 1.5 inch C1022 Phillips Head screw from SIVACO QUEBEC (a Division of IVACO Inc.) was placed in a high-density polyethylene cup containing 100 grams of a 45% (w/w) hexafluorozirconic acid (commercially available from Riedel-de Haen, a subsidiary of Honeywell International, Inc.). The screw was left fully immersed in the acid for 24 hours under ambient conditions {21° C. (70° F.)}. After 24 hours, the screw was removed from the cup and was found to be covered with a uniform light gray film. The screw was immediately rinsed with deionized water for 10 seconds. After 10 seconds, the light gray film was completely removed from the screw and a uniform polished silver surface was revealed. After the deionized water rinse, the screw was immersed in isopropyl alcohol for about 30 seconds. The screw was then dried with a warm air drier at 40° C. (104° F.) for 1 minute. Under ambient laboratory conditions, the dried fastener maintained a uniform polished silver surface with no evidence of red rust or other corrosion product.

Electrocoat Bath Preparation and Coating Deposition of Polished Fastener

The electrodepositable coating composition was prepared using the following mixture of ingredients:

| Ingredients | Parts by Weight (in grams) |
|---|---|
| Acrylic Resin—Powercron P935 commercially available from PPG Industries, Inc. | 2326 |
| Deionized Water | 1474 |

The ingredients were added to a plastic gallon container and mixed under gentle agitation. The resulting paint had a pH of 5.07 and conductivity of 604 microsiemens/cm (μS/cm).

The coating composition was deposited onto the polished fasteners (preparation described above). This was done by heating the coating composition to 80° F. (26.7° C.) and impressing 100 volts between the fastener and a stainless steel anode for 30 seconds. The fasteners were cured for 30 minutes at 350° F. (176.7° C.) to produce an average film thickness of 1.0 mil. Finished fasteners showed enhanced corrosion protection in a humid environment.

Whereas particular embodiments of this invention have been described above for purposes of illustration, it will be evident to those skilled in the art that numerous variations of the details of the present invention may be made without departing from the invention as defined in the appended claims.

What is claimed is:

1. A method of removing rust from a rusted iron-containing metal surface comprising removing rust from the iron-containing metal surface by contacting the surface with a composition comprising fluorometallate anions of a Group IVB metal in which Group IVB metallate is present in an amount of 20 to 80 percent by weight based on total weight of the composition.

2. The method of claim 1 in which the composition also contains hydrogen cations.

3. The method of claim 1, further comprising rinsing the surface with water.

4. The method of claim 1 in which the surface comprises steel.

5. The method of claim 1 in which the surface comprises steel comprising less than 0.25% by weight carbon.

6. The method of claim 1 in which the surface is in the form of a fastener.

7. The method of claim 1 in which the composition is an aqueous solution.

8. The method of claim 1 in which the Group IVB metal comprises zirconium.

9. The method of claim 1 in which the fluorometallate anions comprise hexafluorozirconate.

10. The method of claim 1, wherein the composition consists of:

(a) fluorometallate anions of a Group IVB metal;

(b) water, and (c) optionally at least one of a wetting agent, a cosolvent, and a corrosion inhibitor.

11. The method of claim 1, wherein the surface is contacted with the composition for at least 30 minutes.

12. The method of claim 3, further comprising rinsing the surface with a water-miscible organic solvent after rinsing with water.

13. The method of claim 9 in which the fluorozirconate anions are derived from hexafluorozirconic acid and its water soluble salts.

14. The method of claim 12, further comprising electrocoating the surface after rinsing with the water-miscible organic solvent.

15. The method of claim 14 in which the surface is electrocoated with a cationic electrodepositable composition.

16. A method for removing rust from a rusted steel fastener comprising removing rust from the rusted steel fastener by contacting the fastener with an aqueous solution containing fluorozirconate anions and hydrogen cations in which fluorozirconate is present in an amount of 20 to 80 percent by weight based on total weight of the composition.

17. The method of claim 16 in which the fluorozirconate anions are derived from hexafluorozirconic acid.

18. The method of claim 16, further comprising rinsing the contacted fastener with water.

19. The method of claim 18, further comprising rinsing the fastener with a water-miscible organic solvent after rinsing with water.

20. The method of claim 19, further comprising electrocoating the fastener after rinsing with the water-miscible solvent.

21. The method of claim 20 in which the fastener is electrocoated with a cationic electrodepositable composition.

* * * * *

UNITED STATES PATENT AND TRADEMARK OFFICE

CERTIFICATE OF CORRECTION

PATENT NO. : 7,351,295 B2
APPLICATION NO. : 11/387208
DATED : April 1, 2008
INVENTOR(S) : Michael J. Pawlik et al.

It is certified that error appears in the above-identified patent and that said Letters Patent is hereby corrected as shown below:

Cover page, item [73] change the first word of the name of the Assignee from "PP6" to --PPG--.

Signed and Sealed this

Seventeenth Day of June, 2008

JON W. DUDAS
*Director of the United States Patent and Trademark Office*